US005752153A

United States Patent [19]

Kreiter et al.

[11] Patent Number: 5,752,153

[45] Date of Patent: May 12, 1998

[54] METHOD AND APPARATUS FOR AVOIDING SLIP IN TRANSPORTING A RECORDING SUBSTRATE IN A FIXING STATION OF AN ELECTROGRAPHIC PRINTER OR COPIER

[75] Inventors: Alexander Kreiter; Vassilis Kremastiotis, both of Bundesrepublik, Germany

[73] Assignee: Oce Printing Systems GmbH, Poing, Germany

[21] Appl. No.: 732,417

[22] PCT Filed: Apr. 10, 1995

[86] PCT No.: PCT/DE95/00490

§ 371 Date: Oct. 22, 1996

§ 102(e) Date: Oct. 22, 1996

[87] PCT Pub. No.: WO95/29430

PCT Pub. Date: Nov. 2, 1995

[30] Foreign Application Priority Data

Apr. 27, 1994 [DE] Germany ..... 44 14 733.3

[51] Int. Cl.[6] ..... G03G 15/00

[52] U.S. Cl. ..... 399/384; 226/24; 399/322

[58] Field of Search ..... 399/384, 381, 399/322, 70; 219/216; 226/25, 24, 44, 45

[56] References Cited

U.S. PATENT DOCUMENTS

| | | | |
|---|---|---|---|
| 4,147,922 | 4/1979 | Naeser et al. | 219/216 |
| 4,513,898 | 4/1985 | Spitsbergen | 226/25 X |

FOREIGN PATENT DOCUMENTS

| | | |
|---|---|---|
| 0 572 050 A2 | 1/1993 | European Pat. Off. . |
| 0 572 050 A3 | 1/1993 | European Pat. Off. . |
| WO 91/09352 | 6/1991 | WIPO . |

OTHER PUBLICATIONS

Patent Abstracts of Japan, vol. 5, No. 206, (M–104), 26 Dec. 1981, Tension Controller for Long–scale Sheet, T. Tsutomu, JP 56 122758 dated 26 Sep. 1981.

IBM Technical Bulletin, vol. 35, No. 4B, dated Sep. 1992, Continuous Forms Output Buffer, pp. 436–439.

F & M Feinwerktechnik & Messtechnik, vol. 100, No. 8, dated Aug. 1992, Praezise Gesteuerte Schrittmotoren Ermoeglichen Rueckseitendruck, K. Mayer, pp. 339–343.

*Primary Examiner*—Arthur T. Grimley
*Assistant Examiner*—Quana Grainger
*Attorney, Agent, or Firm*—Hill, Steadman & Simpson

[57] ABSTRACT

In the fixing station, the recording substrate 4 is transported by friction between two rollers (1, 2). In order to tauten the recording substrate (4), it is braked by a braking device (3) upstream of the rollers (1, 2). A length equalizing element (5) equalizes any length differences occurring in the recording substrate (4). The rotational speed of the rollers (1, 2) is controlled as a function of the deflection of the length equalizing element (5). The deflection time (txy) between reaching a deflection point a and a deflection point b is registered and compared with a desired deflection time (tsp). The braking force of the braking device (3) is reduced if the desired deflection time (tsp) is exceeded.

7 Claims, 4 Drawing Sheets

METHOD AND APPARATUS FOR AVOIDING SLIP IN TRANSPORTING A RECORDING SUBSTRATE IN A FIXING STATION OF AN ELECTROGRAPHIC PRINTER OR COPIER

BACKGROUND OF THE INVENTION

The invention relates to a system and a process for avoiding slip during transport of a recording substrate in an electrographic printer or copier. In electrographic printers or copiers, recording substrates in continuous form are conveyed to various units which are arranged along a recording substrate transport path. In order to ensure secure transport of the recording substrate, recording substrates are often used which have an edge perforation. Tractor drives, with the aid of which the recording substrate is able to be transported without slip within specific tolerance levels, engage in the edge perforation.

In the region of the fixing device, particular requirement are placed in relation to slip-free recording substrate transport. In a fixing device, such as is known, for example, from U.S. Pat. No. 4 147 922, the recording substrate is therefore transported by friction between a nip roller and a fixing roller. At least one of the two rollers, which are pressed against each other, is driven by a motor for this purpose. During the passage between the two rollers, of which at least one is heated, a toner image loosely applied on the recording substrate is fused into the recording substrate.

In the case of simple transport of the recording substrate through between the fixing roller and the nip roller, the formation of folds in the recording substrate may occur because of the influence of heat and the high pressure. Therefore, the recording substrate is tautened before passage between the fixing roller and the nip roller. For this purpose, in the recording substrate transport direction, a sliding saddle and a paper brake are provided upstream of the two rollers. The sliding saddle is located between the rollers and the paper brake. The paper brake, which is operated under vacuum, sucks the recording substrate on and brakes the latter more or less severely according to the available vacuum. The force in the recording substrate transport direction which is brought about by the friction between the fixing roller and nip roller counteracts the force which is brought about by the paper brake. The recording substrate is tensioned over the saddle.

The recording substrate is led to the paper brake at constant speed over the recording substrate transport path. In order to equalize temporary differences in the recording substrate transport speed, a loop tensioner is arranged upstream of the paper brake.

Such a loop tensioner is known from WO reference 91/09352. The position of the loop tensioner is scanned by two sensors which are arranged in the region of the maximum and minimum deflection of the loop tensioner. The rotational speed of the rollers which are transporting the recording substrate and are arranged upstream and downstream of the loop tensioner is controlled as a function of the respective position.

It has now been shown that, in the case of the known devices, slip can occur between at least one of the fixing roller and the nip roller and the recording substrate. This slip occurs when the friction between the recording substrate and the saddle and paper brake is greater than the friction between the recording substrate and the rollers. This unfavorable friction behavior has its causes in thermal expansion of the fixing and nip rollers, the oiling up of the fixing roller, uneven nip forces along the fixing and nip rollers and/or in the properties of the recording substrate being processed. Smudging of the printed image or even its destruction cannot with certainty be excluded.

SUMMARY OF THE INVENTION

The invention is based on the object of indicating a system and a process for avoiding slip in the transport of a recording substrate in a fixing station of an electrographic printer or copier with the aid of which the occurrence of slip between the recording substrate on the one hand and the fixing roller and/or the nip roller on the other hand can be counteracted.

This problem is solved using the features specified in patent claims 1 and 7. Advantageous refinements and developments of the invention are specified in the subclaims.

In general terms the present invention is a system for avoiding slip in the transport of a recording substrate, which is present in continuous form, in a fixing station of an electrographic printer or copier. The recording substrate is able to be transported by friction in the recording substrate transport direction by means of two rollers contained in the fixing station. These rollers are preceded by a braking device for tautening the recording substrate in the recording substrate transport direction. The braking device is preceded by a loop tensioner which can be pivoted about a pivot axis, for equalizing the length of the recording substrate transport path to the length of the recording substrate, which can be fed to the fixing station at constant speed. Sensors are assigned to the loop tensioner at its deflection points. A roller drive controller controls the rotational speed of the rollers as a function of reaching these deflection points of the loop tensioner. A time registering module registering the deflection and dwell time between reaching a first deflection point, at which there is a maximum length of the recording substrate transport path, and reaching a second deflection point of the loop tensioner. A comparison device compares the registered deflection and dwell time with a desired deflection and dwell time. A braking force controller controls the braking force of the braking device acting on the recording substrate, the control being such that the braking force is reduced if the desired deflection and dwell time is exceeded by the registered deflection and dwell time. Means are provided which bring about a variation in the basic setting of braking force and roller rotational speed when a limiting value of the braking force is reached.

Advantageous developments of the present invention are as follows.

The braking force controller controls the braking force such that the braking force is increased if the desired deflection time (tsp) is not reached.

On reaching a minimum braking force the roller drive controller increases the difference between the roller rotational speeds, which are set on reaching various deflection points of the loop tensioner. The braking force controller sets the braking force to a desired value.

If a maximum braking force is present and a deflection time corresponding to the desired deflection time is present, the roller drive controller lowers the difference between the roller rotational speeds, which are set on reaching various deflection points of the loop tensioner. The braking force controller sets the braking force to a desired value.

If a minimum braking force is present and if a maximum difference between the roller rotational speeds is present and if a maximum deflection time is exceeded, the printing operation is interrupted.

A pneumatic brake, which is coupled via a controllable valve to a blower, is provided as braking device. The present invention is also a process for avoiding slip in the transport of a recording substrate, which is present in continuous form, in a fixing station of an electrographic printer or copier. The recording substrate is able to be transported by friction in the recording substrate transport direction by means of two rollers contained in the fixing station. These rollers being preceded by a braking device for tautening the recording substrate in the recording substrate transport direction. The braking device is preceded by a loop tensioner, which can be pivoted about a pivot axis, for equalizing the length of the recording substrate transport path to the length of the recording substrate, which can be fed to the fixing station at constant speed. Sensors are assigned to the loop tensioners at its deflection points. In a first step the rotational speed of the rollers is controlled as a function of reaching these deflection points of the loop tensioner. In a second step the deflection and dwell time between reaching the deflection point, at which there is a maximum length of the recording substrate transport path, and reaching another deflection point of the loop tensioner is registered. In a third step the registered deflection and dwell time is compared with a desired deflection and dwell time. In a fourth step the braking force of the braking device acting on the recording substrate is controlled such that the braking force is reduced if the desired deflection and dwell time is exceeded by the registered deflection and dwell time, and a variation in the basic setting of braking force and roller rotational speed is carried out when a limiting value of the braking force is reached.

By virtue of the invention, any slip occurring can be detected so early that countermeasures can be introduced before impairment to the printed image can occur. In the case of a change in the paper properties, the nip forces between fixing roller and nip roller because of their thermal expansion, it is no longer necessary to stop the printer or copier and to undertake manual changes to the nip forces or braking forces. Rather, these forces are automatically adapted to one another in such a way that any slip occurring can be eliminated without interrupting operations.

According to a refinement and development of the invention, the braking force controller controls the braking force such that the braking force is increased if the desired deflection time is not reached. This ensures not only that any possible slip is prevented but, in addition, also that the best possible tautening of the recording substrate upstream of the fixing and nip rollers is ensured.

According to a further development and refinement of the invention, on reaching the minimum braking force the difference between the roller rotational speeds, which are set on reaching various deflection points of the length equalizing element, is increased. In addition, the braking force controller sets the braking force to a desired value. As a result of these measures, the setting range is increased such that for the case where slip still occurs in spite of a reduction of the braking force to a minimum value, this slip can be counteracted further.

By virtue of a further development and refinement of the invention, if a maximum braking force is present and a deflection time corresponding to the desired deflection time is present, the difference between the roller rotational speeds, which are set on reaching various deflection points of the length equalizing element, is lowered. Furthermore, the braking force controller controls the braking force to a desired value. By virtue of these measures, for the case in which there is no slip, the tautening of the recording substrate before its passage through the nip roller and fixing roller can be optimized.

According to a further development and refinement of the invention, if a minimum braking force is present, a maximum difference between the roller rotational speeds is present and the maximum deflection time is exceeded, the printing operation is interrupted. By virtue of this measure it is ensured that, for the case in which all the setting possibilities have been exhausted and slip is nevertheless occurring, the printing operation is interrupted and an issue of recording substrates printed with an insufficient printed image is avoided.

According to a further development and refinement of the invention, a pneumatic brake, which is coupled via a controllable valve to a blower, is provided as braking device. With the aid of the pneumatic brake, the recording substrate can be sucked more or less strongly onto the sliding surface of the braking device. By varying the vacuum, the frictional resistance can be varied. A variation in the vacuum can be undertaken in a simple way by means of a controllable valve.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
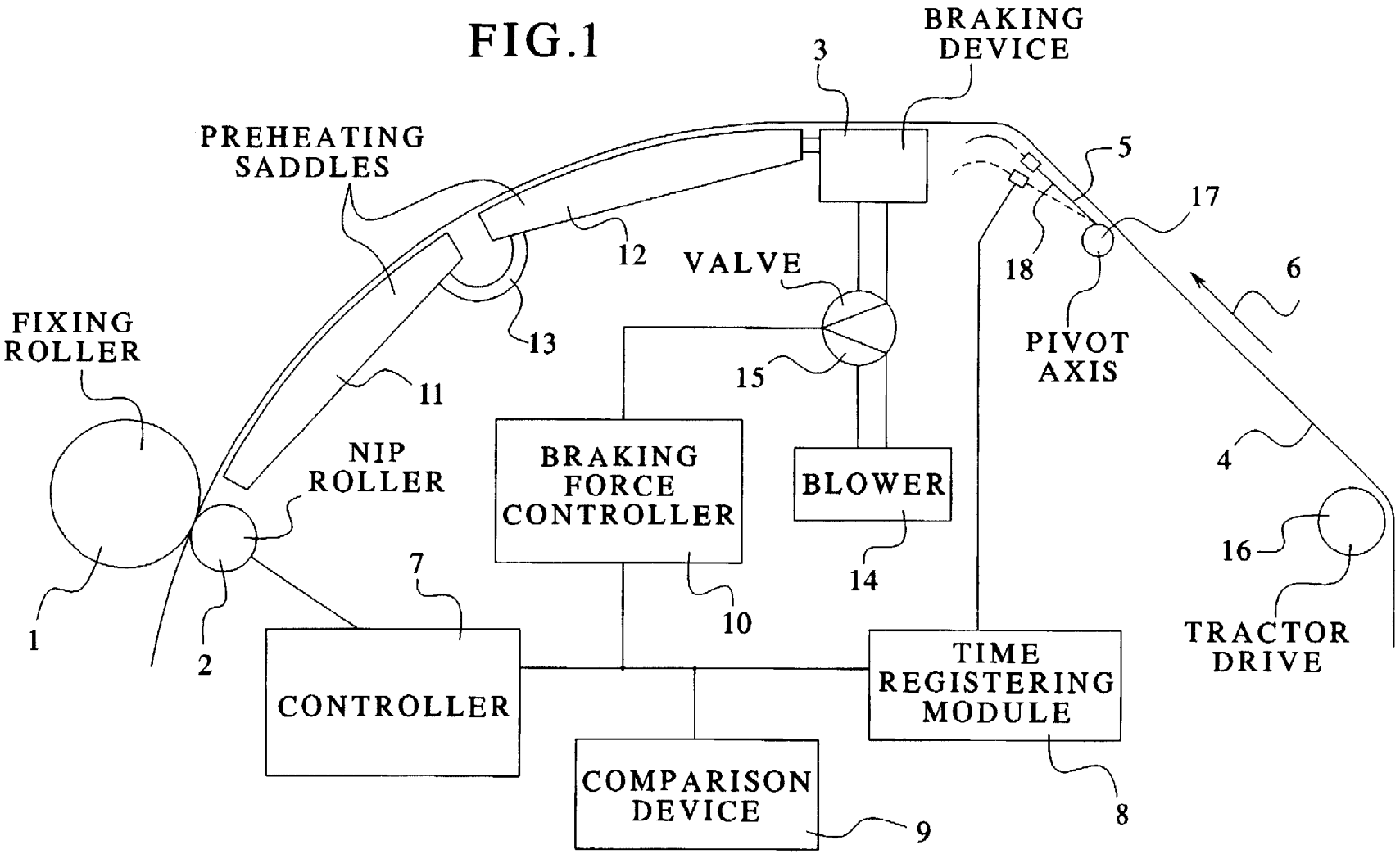
FIG. 1 shows a schematic representation of a fixing station of an electrographic printer or copier.

An electrographic printer or copier for printing recording substrates 4 in the form of continuous paper contains a fixing station, shown schematically in FIG. 1. The fixing station is designed as a thermoprinting fixing station. It contains a heated fixing roller 1 and a nip roller 2. The nip roller 2 is pressed in the direction of the fixing roller 1 by a pivoting and pressing device, not shown. The fixing roller 1 comprises an aluminum cylinder with a heat-resistant coating arranged thereon. The fixing roller 1, which is driven by an electric motor, is supplied with release agent by an oiling device, not shown. The release agent prevents the adherence of toner particles on the coating of the fixing roller 1. The drive of the fixing roller 1 and of the nip roller 2, comprising aluminum coated with silicone, is carried out by means of an electric motor drive. This electric motor drive is assigned a roller drive controller 7, which controls the drive in accordance with the desired roller speed. A recording substrate 4 is transported by friction between the fixing roller 1 and the nip roller 2. The transport is carried out in the recording substrate transport direction 6.

The fixing and nip rollers 1, 2 are preceded in the recording substrate transport direction 6 by a first and a second preheating saddle 11, 12. With the aid of the preheating saddles 11, 12, the continuous paper 4 is preheated for the actual fixing process between the fixing and nip rollers 1, 2. For this purpose, the continuous paper 4 slides flat on the sliding surfaces of the preheating saddles 11, 12 which face the continuous paper 4. In order to optimize the contact between the sliding surfaces and the continuous paper 4, the preheating saddles 11, 12 have suction openings, not shown, which are connected via hose connections 13 and a braking device 3, positioned upstream of the preheating saddles 11, 12 in the recording substrate transport direction 6, to a blower 14 producing a vacuum. The braking device 3 is coupled to the blower 14 via a valve 15. The valve 15 can be controlled by a braking force controller 10 in such a way that a desired vacuum can be set in the braking device 3. By virtue of the interaction of the braking device 3 with the fixing and nip rollers 1, 2, two opposed forces, namely a driving force directed in the recording substrate transport direction 6 and a braking force directed counter to the recording substrate transport direction 6, act on the continuous paper 4. In consequence, the continuous paper 4 is drawn free of folds over the preheating saddles 11, 12.

Figure 2:
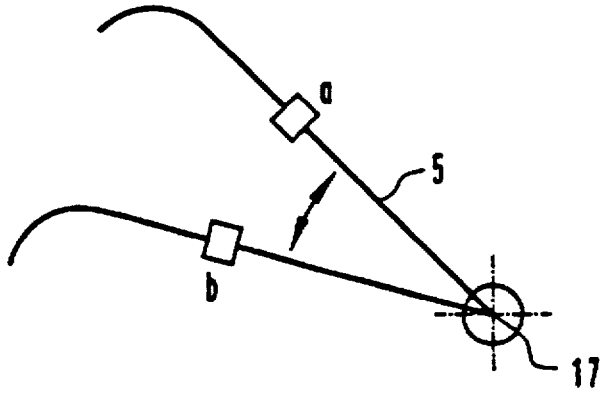
FIG. 2 shows a representation of the principle of a length equalizing element of the fixing station.

By means of a tractor drive 16, the continuous paper is fed at constant speed VA (see FIG. 3) to the region between braking device 3 and the rollers 1, 2. In order to counteract speed fluctuations in the fixing station, and to avoid negative effects on the recording substrate 4, a length equalizing element 5 is provided upstream of the braking device 3 in the recording substrate transport direction 6. The length equalizing element 5 is designed as a loop tensioner 5. The loop tensioner 5 is mounted so that it can pivot about a pivot axis 17. From this pivot axis 17, a guiding metal sheet 18 bent over at its outer end extends in the recording substrate transport direction 6. The guiding metal sheet 18 is pressed outward by a spring, not shown, such that the recording substrate transport path is lengthened. The loop tensioner 5 can be pivoted between two end positions, see FIG. 2. At the end position in which the recording substrate transport path has its maximum length, a first sensor a is arranged. A second sensor b is arranged in the pivoting position of the loop tensioner 5 in which the recording substrate transport path reaches its minimum length. The sensors a, b are coupled electrically to a time registering module 8. This time registering module 8 registers both the reaching of the loop tensioner of a sensor a, b and also the time which elapses between reaching the first sensor a and reaching the second sensor b and vice versa. The time registering module 8 is coupled to the roller drive controller 7, a comparison device 9 and the braking force controller 10 in such a way that information may be exchanged between these units.

Figure 3:
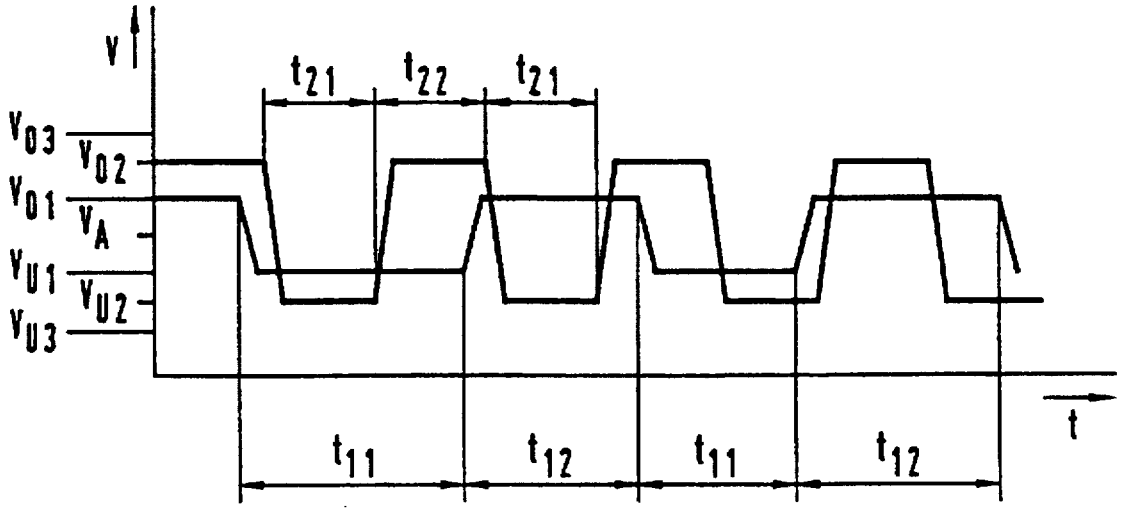
FIG. 3 shows a time/speed diagram of the fixing and nip rollers of the fixing station.

According to FIG. 3, the paper is conveyed by the tractor drive 16 at constant speed VA to the fixing station. There, it is gripped by the fixing roller 1 and the nip roller 2 and conveyed by friction in the recording substrate transport direction 6. In so doing, it is tensioned between the braking device 3 and the rollers 1, 2 over the preheating saddles 11, 12. The loop in the continuous paper 4 upstream of the braking device 3 ensures secure functioning of the fixing device and protection of the continuous paper 4 against damage. The rotational speed of the fixing and nip rollers 1, 2 is controlled as a function of the loop size. If there is a large loop, the paper transport in the fixing station is, for example, accelerated to a speed VO1. If there is a small loop, the paper transport in the fixing station is decelerated to a lower speed VU1. The upper paper speed VO1 is greater than the average speed VA, and the lower paper speed VU1 is lower than the average paper speed VA.

The loop size is registered by the two sensors a, b of the loop tensioner 5. The presence of the large loop is reported by the first sensor a and the presence of the small loop is reported by the second sensor b to the time registering module 8. In regular slip-free operation, the loop information obtained is forwarded to the roller drive controller 7, which changes the rotational speed of the fixing and nip rollers 1, 2 accordingly. In addition, the time registering module 8 determines the time intervals between reaching the first sensor a and reaching the second sensor b, and vice versa. These times t11, t12 depend on the speed of the continuous paper 4 and are constant in the normal case. If slip is now effected between fixing and/or nip rollers 1, 2 and the continuous paper 4, the time increases for reducing the loop. This is the time during which the loop tensioner 5 moves from the first sensor a to the second sensor b. The lengthening of this time t12 is in this case directly proportional to the slip. This time t12 is therefore suitable as a measure of the slip.

Since the time t12 is a measure of the slip, it is reported by the time registering module 8 to the comparison device 9. In the comparison device 9, the loop reduction time t12 is compared with a desired time tsp. Depending on a result this comparison, measures which counteract slip are introduced using the roller drive controller 7, the braking force controller 10 and the comparison device 9, which are all coupled to one another. These measures include a variation of the range of fluctuation of the paper speed v in the fixing station and a variation of the braking force of the braking device 3. The braking force can be varied by varying the vacuum p in the braking device 3. The vacuum p can be set by the valve 15.

Figure 4:
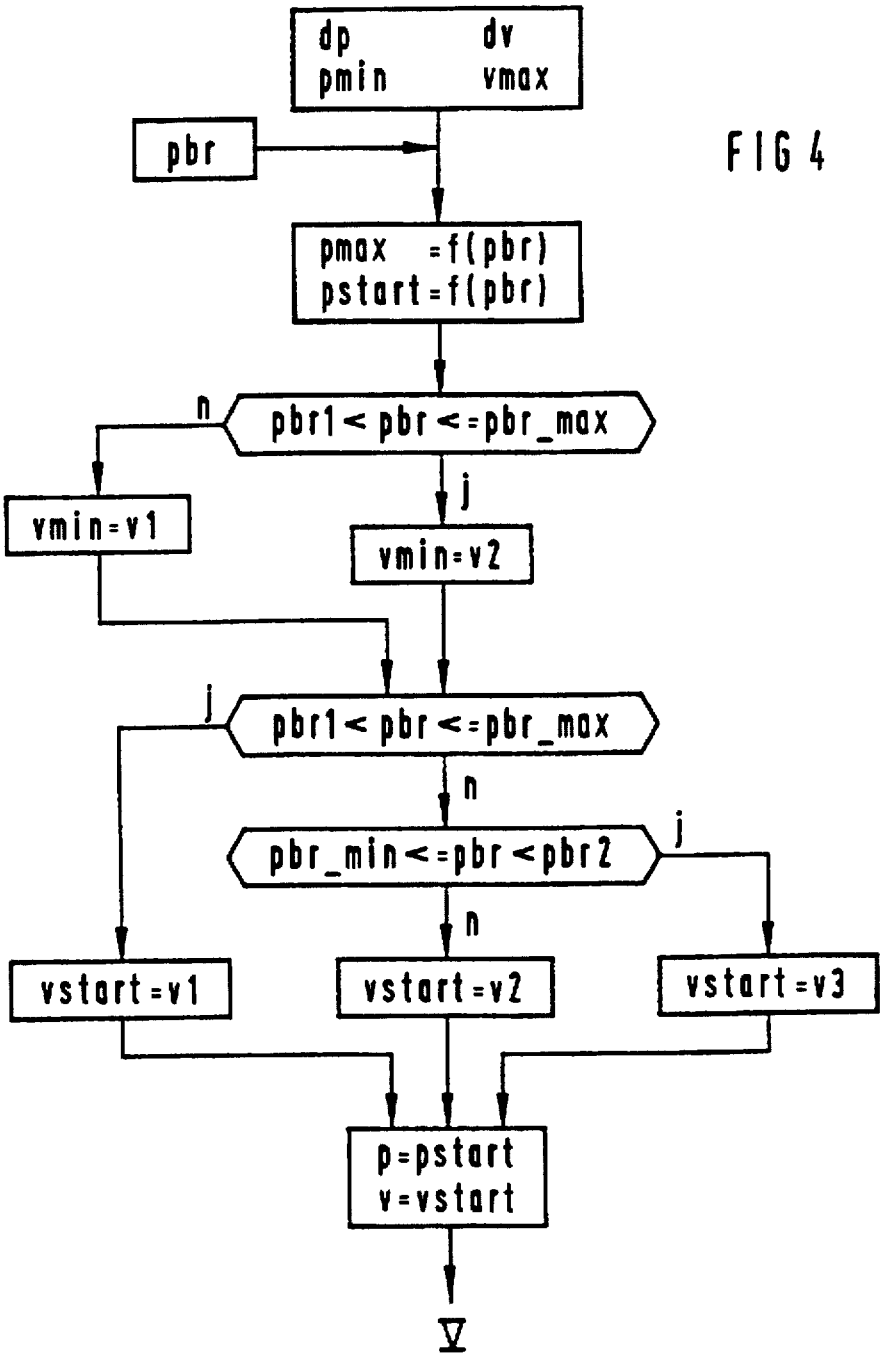
FIG. 4 shows a flow diagram for defining the starting conditions for the process according to the invention and FIG. 5 shows a flow diagram for the process according to the invention for avoiding slip in the transport of a recording substrate.

Since it is possible to process different recording substrates 4 using a printer or copier, starting conditions for the transport of the recording substrate 4 in the fixing station must be defined or determined before beginning the printing or copying process. The properties of the recording substrate 4 include its width pbr, its paper weight, its surface condition, electrostatic properties, any pre-printing on the recording substrate 4, etc. According to FIG. 4, a pressure change value dp for the braking device 3, a speed change value dv, a maximum paper speed vmax, a minimum pressure pmin and the paper width pbr are prescribed. The speed change value dv and the pressure change value dp specify the increment by which speed v and vacuum p may be changed during the process. As a function of the paper width pbr, a maximum pressure pmax and a starting pressure pstart are determined. In a further step, a minimum speed vmin is defined as a function of the paper width pbr. If the paper width is smaller than a first limiting value for the paper width pbr 1, a minimum speed of vmin=v1 is then set. If the paper width pbr is greater than the first limiting value of the paper width pbr 1 and smaller than or equal to a maximum paper width pbr max, a minimum speed vmin=v2 is then set. In this case, it is true that $$v2=v1+dv$$

In a further step, the starting speed vstart is determined as a function of the paper width pbr. If the paper width pbr is greater than the first limiting value of the paper width pbr 1 and smaller than or equal to the maximum paper width pbr max, a starting speed vstart=v1 is then set. If the paper width is greater than or equal to a minimum paper width pbr min but smaller than a second limiting value of the paper width pbr 2, a starting speed vstart=v3 is set. If neither of the first-mentioned conditions applies, a starting speed vstart=v2 is set. In this case, it is true that $$v3=v1+2\cdot dv$$

Figure 5:
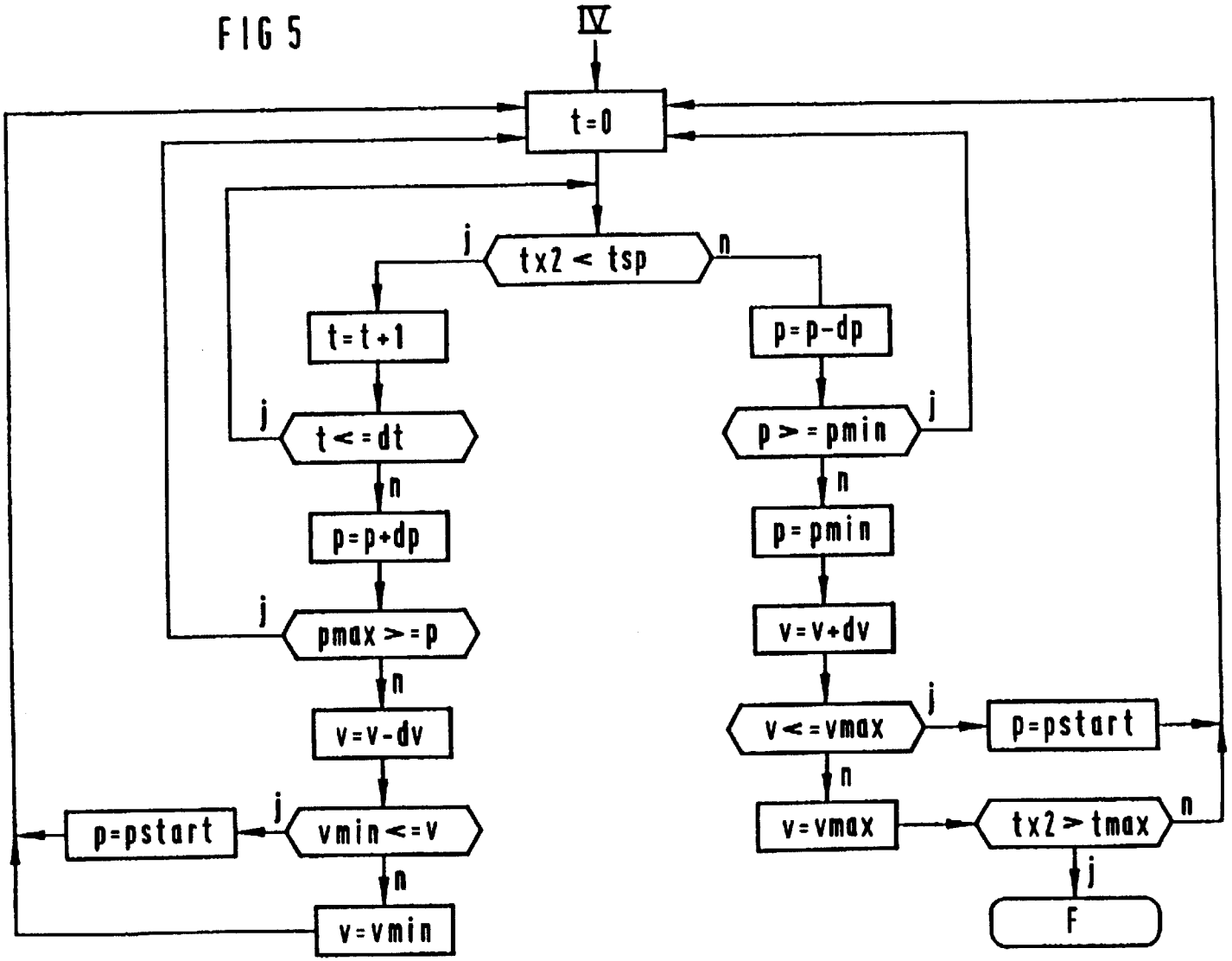

The process for avoiding slip is represented in the flow diagram according to FIG. 5. Initially, a time variable t=0 is set. The time registering module 8 supplies the time interval t×2, which specifies the time which the loop tensioner 5 needs for a movement from the first sensor a to the second sensor b. The time interval t×2 depends on the constant speed vA and the difference between the upper speed VO1, VO2, VO3 and the lower speed VU1, VU2, VU3. Here, it is true that V1=(VU1, VO1), V2=(VU2, VO2), V3=(VU3, VO3).

The time interval t×2 is compared with a desired time tsp. The desired time tsp is constant for all the possible speeds v1, v2, v3. If, however, the speed change value dv is selected to be large, it must then be varied in accordance with the set speed. The desired time tsp is increased if the upper paper speed VO1, VO2, VO3 is reduced, and is reduced if the upper speed VO1, VO2, VO3 is increased. The permissible slip can thereby be kept constant in spite of a great range of fluctuation of the speed v.

If the time interval t×2 is greater than the desired time tsp, the vacuum p is reduced by the pressure change value dp. A check is then made as to whether the vacuum p is greater than or equal to the minimum pressure pmin. If this is the case, the time variable is then set to t=0 and a further comparison of the time interval t×2 with the desired time tsp is carried out. If the time interval t×2 is still larger than the desired time tsp, the vacuum p is reduced further until it is less than the minimum pressure pmin.

If this is the case, the vacuum p is set once more to the value of the minimum pressure pmin and the paper speed is increased by the speed change value dv. If the paper speed v following its change is less than or equal to the maximum paper speed vmax, the vacuum p is then set to the value of the starting pressure pstart and the control process is begun once more following setting of the time variable to t=0. If the value of the paper speed v following its increase is greater than the maximum paper speed vmax, the paper speed v=vmax is set. A check is then made as to whether the time interval t×2 is greater than a maximum value tmax for the time interval t×2. In this case, it is true that $$t_{max}>t_{sp}.$$

If the time interval t×2 is greater than the maximum desired time tmax, the printing operation is interrupted and a fault message F is output on the printer or copier. If the time interval t×2 is, however, not greater than the maximum desired time tmax, the printing operation is maintained.

If the time interval t×2 is smaller than the desired time tsp, the tautening of the continuous paper 4 is optimized. If the condition that the time interval t×2 is smaller than the desired time tsp is always fulfilled during a comparison time dt, and if subsequently the comparison time dt is exceeded, the vacuum p is increased by the pressure change value dp. If, following this pressure increase, the value of the vacuum is less than or equal to the maximum pressure pmax, the time variable is then set to t=0 and the control process is started anew. If, on the other hand, the value of the vacuum p exceeds the maximum pressure pmax, the paper speed v is reduced by the speed change value dv. If the value of the paper speed v following its reduction is greater than or equal to the minimum paper speed vmin, the vacuum p is then set to the starting pressure pstart and the control process is started anew. If the value of the paper speed v is smaller than the minimum speed vmin, the paper speed v is then set to the value of the minimum speed vmin and the control process is started anew. If therefore the maximum pressure pmax and the minimum speed vmin have been reached and the time interval t×2 is smaller than the desired time tsp, no more changes are made, since slip is no longer occurring.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. A system for avoiding slip during transport of a recording substrate in a fixing station of an electrographic printer or copier, the recording substrate having a continuous form, comprising:

the recording substrate being transportable by friction in a recording substrate transport direction by two rollers contained in the fixing station;

said rollers being preceded by a braking device for tautening the recording substrate in the recording substrate transport direction;

the braking device being preceded by a loop tensioner which is pivotable about a pivot axis for equalizing the length of the recording substrate transport path to the length of the recording substrate, which is feedable to the fixing station at constant speed;

sensors respectively assigned to the loop tensioner at first and second deflection points thereof;

a roller drive controller controlling a rotational speed of the rollers as a function of reaching said first and second deflection points of the loop tensioner;

a time registering module registering a deflection and dwell time between reaching the first deflection point, at which there is a maximum length of the recording substrate transport path, and reaching the second deflection point of the loop tensioner;

a comparison device comparing the registered deflection and dwell time with a desired deflection and dwell time;

a braking force controller controlling a braking force of the braking device acting on the recording substrate, the control being such that the braking force is reduced if the desired deflection and dwell time is exceeded by the registered deflection and dwell time; and device for varying a basic setting of braking force and roller rotational speed when a limiting value of the braking force is reached.

2. The system as claimed in claim 1, wherein the braking force controller controls the braking force such that the braking force is increased if the desired deflection time is not reached.

3. The system as claimed in claim 1, wherein, on reaching a minimum braking force:

the roller drive controller increases a difference between roller rotational speeds of the rollers, the speeds being set on reaching various deflection points of the loop tensioner; and the braking force controller sets the braking force to a desired value.

4. The system as claimed in claim 1, wherein, if a maximum braking force is present and a deflection time corresponding to the desired deflection time is present:

the roller drive controller lowers a difference between roller rotational speeds of the rollers, the speeds being set on reaching various deflection points of the loop tensioner; and the braking force controller sets the braking force to a desired value.

5. The system as claimed in claim 1, wherein, if a minimum braking force is present, and if a maximum difference between the roller rotational speeds is present, and if a maximum deflection time is exceeded, the printing operation is interrupted.

6. The system as claimed in claim 1, wherein the system further comprises a pneumatic brake, which is coupled via a controllable valve to a blower, as braking device.

7. A process for avoiding slip in transporting a recording substrate in a fixing station of an electrographic printer or copier, the recording substrate having a continuous form, comprising the steps of:

providing that the recording substrate is transportable by friction in a recording substrate transport direction by two rollers contained in the fixing station;

said rollers being preceded by a braking device for tautening the recording substrate in the recording substrate transport direction, and the braking device being preceded by a loop tensioner, which is pivotable about a pivot axis, for equalizing a length of the recording substrate transport path to a length of the recording substrate, which is feedable to the fixing station at constant speed; and sensors being assigned to the loop tensioner and respectively located adjacent at least first and second deflection points thereof;

controlling the rotational speed of the rollers as a function of reaching said first and second deflection points of the loop tensioner;

registering a deflection and dwell time between reaching the first deflection point, at which there is a maximum length of the recording substrate transport path, and reaching the second deflection point of the loop tensioner;

comparing the registered deflection and dwell time to a desired deflection and dwell time;

controlling the braking force of the braking device acting on the recording substrate such that the braking force is reduced if the desired deflection and dwell time is exceeded by the registered deflection and dwell time, and a variation in the basic setting of braking force and roller rotational speed is carried out when a limiting value of the braking force is reached.

* * * * *